United States Patent [19]

Batz

[11] 4,104,088

[45] Aug. 1, 1978

[54] METHOD OF MAKING DIFFERENTIALLY COATED ONE SIDE ALLOYED GALVANIZED STEEL STRIP

[75] Inventor: Walter Batz, Hopewell Township, Beaver County, Pa.

[73] Assignee: Jones & Laughlin Steel Corporation, Pittsburgh, Pa.

[21] Appl. No.: 799,876

[22] Filed: May 23, 1977

[51] Int. Cl.[2] ..... C23C 1/02

[52] U.S. Cl. ..... 148/12 R; 148/12 C; 148/12 D; 427/357; 427/360; 427/383 D; 427/433

[58] Field of Search ..... 148/12 R, 12 C, 12 D; 427/383 D, 433, 357, 360

[56] References Cited

U.S. PATENT DOCUMENTS 3,056,694 10/1962 Mehler et al. ..... 427/383 D 3,977,842 8/1976 Mayhew ..... 427/433

FOREIGN PATENT DOCUMENTS 904,485 8/1962 United Kingdom ..... 427/433

*Primary Examiner*—W. Stallard

*Attorney, Agent, or Firm*—Gerald K. White; T. A. Zalenski

[57] ABSTRACT

Zinc coated steel strip is produced by passing a strip through a molten zinc bath containing from 0.15% to 0.18% aluminum, controlling zinc coating weights to produce a relatively light coating of 0.20 oz./sq.ft. maximum on one side and a relatively heavy coating of 0.20 oz./sq.ft. minimum in the other side, and then uniformly heating both sides for a time and temperature sufficient to completely form an iron-zinc alloy on the light coated side and yet retain the essentially unalloyed zinc coating on the heavy coated side.

5 Claims, 1 Drawing Figure

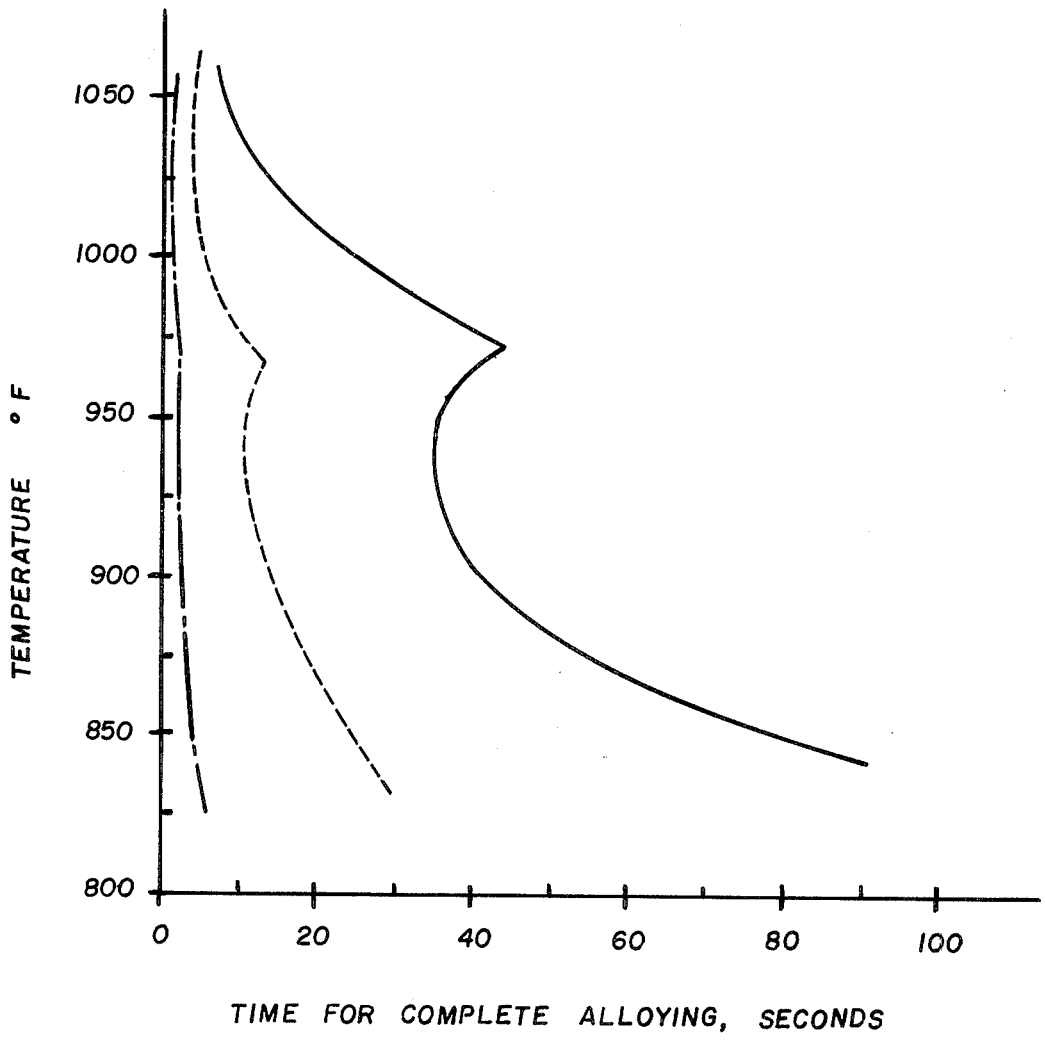
1050
1000
950
900
850
800
TEMPERATURE °F
0
20
40
60
80
100
TIME FOR COMPLETE ALLOYING, SECONDS

METHOD OF MAKING DIFFERENTIALLY COATED ONE SIDE ALLOYED GALVANIZED STEEL STRIP

The invention generally relates to a method for the production of zinc coated steel strip products having a full commerical unalloyed zinc coating on one side and a fully alloyed iron-zinc coating on its other side. The iron-zinc alloy is formed through alloying of the zinc coating and the steel substrate. A product of this nature offers a highly desirable combination of properties peculiar to each type of coating for a single product. The superior paintability and resistance spot weldability of the alloyed side of the product is attractive for applications in which the external surface would be painted and where the other, unalloyed, side would not be painted and subject to aggressive corrosion conditions during use. Typical end uses for such products would include certain parts of agricultural machinery, trucks, automobiles, and appliances.

A product of the general nature described above is disclosed in U.S. Pat. No. 3,112,213. This patent describes a process for making such product that depends upon localized heating of one of the zinc coated substrate sides following its passage through the galvanizing pot. On the other hand, the process of this invention produces a similar product through the discovery that the use of a critical, carefully controlled, interrelationship of coating thickness, aluminum content of the zinc coating bath, and a simple, uniform heat treatment will result in such product. Specifically, it has been discovered that the product of the invention may be produced by passing a steel substrate through a molten zinc bath containing from about 0.15% to 0.18% aluminum to form a zinc coating on both sides of the substrate, controlling the zinc coating to form a light coating of 0.20 oz./sq.ft. maximum on one side and a heavy coating of 0.30 oz./sq.ft. minimum on the other side, and then passing the differentially zinc coated substrate through a heated furnace so as to uniformly heat the product for a time and at a temperature sufficient to form a completely alloyed coating on the light side and to retain an essentially unalloyed zinc coating on the heavy side. A precise correlation or combination of aluminum content of the zinc coating bath, coating weight for each side, and heat treatment is required to obtain such product.

It is thus an object of the invention to provide a process for producing a coated steel substrate having a fully alloyed zinc coating on one side and an essentially unalloyed zinc coating on its other side.

It is an additional objective to provide a process in which a simple effective heat treatment may be utilized. These and additional objectives and advantages will become apparent to those skilled in the art from the following description of the invention.

The sole FIGURE graphically illustrates times and temperatures required to achieve complete alloying of the coating for zinc coatings containing three levels of aluminum.

Differentially zinc coated substrates produced by continuously hot dipping a steel substrate in a conventional galvanizing pot containing molten zinc may be obtained by wiping or otherwise removing a portion of one or both of the coated sides as the strip emerges from the galvanizing pot. The technology to perform the wiping step is known and includes techniques discussed in aforementioned U.S. Pat. No. 3,112,213 such as grooved exit rolls, wiper blades, or an air blast applied on the meniscus at the exit rolls. The use of the fluid wiping technique disclosed in U.S. Pat. No. 3,917,888 may also be employed to obtain a differential coating in accordance with the invention by use of a differential fluid blast. This constitutes a preferred control technique due to its overall compatibility with conventional galvanizing apparatus.

The substrate of the invention may comprise any low carbon steel strip. A typical example of a commonly utilized low carbon steel is C1010. The low carbon steel may be in the rimmed, capped, or killed deoxidation state. For temper rolled applications, aluminum killed low carbon steels are preferred.

It has been discovered that the thickness of zinc coating on each side of the substrate following the thickness control step must be such that the light side is about 0.20 oz./sq.ft. maximum and the heavy side is 0.30 oz./sq.ft. minimum. The above coating weight limits are necessary because of the interaction with the aluminum content in the galvanizing pot and the subsequent heat-treating step to produce a fully alloyed coating on the light side and an essentially unalloyed coating on the heavy side. As coating weight or thickness increases, the time and temperature required for complete alloying also increases. A 0.20 oz./sq.ft. coating is the maximum thickness that will result in complete alloying within the aluminum content and heat-treatment constraints of the invention and a 0.30 oz./sq.ft. represents the minimum thickness that will remain essentially unalloyed when processed in accordance with the invention. Coating weights in excess of 0.20 oz./sq.ft. involve increases in the time required to obtain complete alloying that are disproportionate with increases in coating weight. Such higher alloying times entail the risk of unintentionally alloying the more heavily coated side.

The aluminum content of the zinc bath in the galvanizing pot and the resultant coating must be maintained from 0.15% to 0.18% because of the influence of aluminum upon alloying behavior. The above limits have been selected because they result in alloying times compatible with the coating weights and heat-treating temperatures of the invention.

Aluminum contents less than 0.15% are undesirable because alloying proceeds at essentially the same rate for both light and heavy coatings with resultant marginal to poor coating adhesion. The Table illustrates this effect through comparison of coating adhesion resulting from use of 0.13% and 0.17% aluminum galvanizing baths for three coating weights. Aluminum contents greater than 0.18% retard alloying to such an extent that alloying times in excess of those of commercial practicability are required.

The sole FIGURE generally illustrates combinations of aluminum content and the heat-treatment time and temperatures required to obtain complete alloying of the zinc coating. The dashed line represents the interaction of 0.13% aluminum and a coating weight of 0.18 oz./sq.ft., the dotted line represents 0.18% aluminum and a coating weight of 0.18 oz./sq.ft., and the solid line represents 0.19% aluminum and a 0.10 oz./sq.ft. coating weight. As may be seen, for a constant temperature, increasing aluminum contents lead to increases in alloying time. As may be further seen, an aluminum content of 0.17% is useful in combination with commercially obtainable heat-treatment times and temperatures for thicknesses within those of the invention. It is preferred to maintain the aluminum content of the molten zinc bath from 0.16% to 0.17% to further ensure that complete iron-zinc alloying of the light coating side will occur at commerically feasible times and temperatures. A 0.19% aluminum content, even at a relatively light coating weight of 0.10 oz./sq.ft., retards alloying to an extent that an unacceptable processing time penalty is incurred. The general effect of aluminum as an iron-zinc alloying retarding element and the presence of discontinuities between 950° F and 1000° F as depicted in the FIGURE is consistent with the findings of H. Smith and W. Batz in an article beginning at page 895 of the December 1972 issue *Journal of the Iron and Steel Institute,* entitled "Iron-Zinc Alloy Formation During Gelvannealing".

TABLE

COATING ADHESION OF ZINC COATINGS FOR CONDITIONS RESULTING IN COMPLETE ALLOYING OF .18 oz./sq.ft./side COATING

| | Adhesion Rating,* 1-T Bend Test | | | | | | | |
|---|---|---|---|---|---|---|---|---|
| | .13% Al Zn Bath | | | | k .17% Al Zn Bath | | | |
| Temperature | Time Seconds | .18 oz./sq.ft** | .30 oz./sq.ft. | .45 oz./sq.ft. | Time Seconds | .18 oz./sq.ft. | .30 oz./sq.ft. | .45 oz./sq.ft. |
| 850° F | 4 | G | G | M | 25 | G | G | G |
| | 6 | M | M | M | 40 | G | G | G |
| | 8 | M | M | M | | | | |
| 900° F | 4 | G | M | M | 15 | G | G | G |
| | 6 | M | M | M | 20 | G | G | G |
| | 8 | M | M | M | | | | |
| 950° F | 2 | G | M | M | 10 | G | G | G |
| | 4 | M | M | M | 15 | G | G | G |
| | 6 | M | M | M | | | | |
| 1000° F | 2 | G | M | B | 5 | G | G | G |
| | 4 | M | B | B | 10 | G | G | G |
| | 6 | M | B | B | | | | |
| 1050° F | 2 | M | M | B | 5 | G | G | G |
| | 4 | M | B | B | 10 | G | G | G |
| | 6 | M | B | B | | | | |

*G-Good Adhesion, no flaking or spalling
M-Marginal adhesion, coating spalls when scraped lightly
B-Bad adhesion, coating flakes and spalls after 1-T bend
**Coating weight oz./sq.ft./side The heat-treatment step is performed following the coating control or adjustment step that results in the differentially zinc-coated substrate. The heat-treatment comprises uniformly heating both sides of the differentially coated steel substrate for a time and at a temperature sufficient to form a fully alloyed iron-zinc coating on the lighter weight side and yet insufficient to cause appreciable alloying of the heavier weight side. Furnace temperatures on the order of 1000° F maximum for a maximum time of about ten seconds can be utilized to produce the desired product by passing the differentially coated substrate through a continuous type furnace. This procedure subjects the moving substrate to a uniform heat treating temperature with respect to each side of the substrate. It is preferred to pass the strip through a furnace heated between about 900° F and 950° F for a time on the order of ten seconds to twenty seconds because higher temperatures tend to promote a rough surface on the alloyed side characterized by sporadic nucleation of iron-zinc alloy bursts or sprays which enlarge disproportionately at the expense of the surrounding unalloyed zinc.

Following heat-treatment, the coated steel strip may be optionally temper rolled to produce a product having drawing properties equivalent to Aluminum Killed Drawing Quality steel strip. The term "Aluminum Killed Drawing Quality" is defined in "Steel Products Manual" on "Carbon Sheet Steel" published by the American Iron and Steel Institute (April 1974). Such product is highly desirable for automotive applications involving forming and one-sided painting operations. Products of this nature require the use of an aluminum-killed low carbon strip that has been batch annealed prior to the differential galvanizing step. Such batch annealing typically involves a times on the order of 10 to 16 hours and temperatures on the order of 1300° F. Following differential coating and the one-sided alloying heat-treatment, the coated strip is annealed at 600° F maximum for about 12 to 24 hours to eliminate carbon aging and to obtain properties associated with good formability such as a lower yield point and higher elongation. The use of temperatures greater than about 600° F involves the risk of causing the heavy, unalloyed side of the strip to alloy. Temper rolling on the order of one percent or less is then performed to eliminate stretcher strains and to impart a desirable surface texture to the product. Temper rolling imparts a matte-like finish to the alloyed side of the strip that is similar to the appearance of normal cold rolled or temper rolled steel.

I claim:

1. A method for producing a zinc coated and heat-treated sttel substrate, comprising:

passing a low carbon steel substrate through a molten zinc bath containing from 0.15% to 0.18% aluminum so as to form an essentially unalloyed zinc coating on both sides of said substrate; controlling the zinc coating so as to obtain a coating weight of about 0.20 oz./sq.ft. maximum on a first side of said substrate and about 0.30 oz./sq.ft. minimum on a second side; and uniformly heating both sides of said zinc coated substrate for a time and to a temperature sufficient to form a fully alloyed iron-zinc coating on said first side and to retain the essentially unalloyed zinc coating on said second side.

2. The method of claim 1, wherein:

said zinc bath contains from 0.16% to 0.17% aluminum.

3. The method of claim 1, wherein:

said zinc coated substrate is heated at a maximum temperature of about 1000° F for a maximum time of about ten seconds.

4. The method of claim 1, wherein:

said zinc coated substrate is heated at a temperature from about 900° F to 950° F for a time of about 10 to 20 seconds.

5. The method of claim 1 which further includes:

batch annealing said zinc coated substrate at a maximum temperature of 600° F for 12 to 24 hours; and then temper rolling said substrate to obtain a product having drawing properties equivalent to those of Aluminum Killed Drawing Quality steel.

* * * * *

UNITED STATES PATENT OFFICE

CERTIFICATE OF CORRECTION

Patent No. 4,104,088 Dated August 1, 1978

Inventor(s) Walter Batz

It is certified that error appears in the above-identified patent and that said Letters Patent are hereby corrected as shown below:

In the Abstract, 5th line: 0.20 should be - 0.30 -;

Table, 18th line: "k" should be deleted;

Claim 1, line 39: "sttel" should be - steel -.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*